US006579155B1

(12) United States Patent
Luderich et al.

(10) Patent No.: US 6,579,155 B1
(45) Date of Patent: Jun. 17, 2003

(54) METHOD AND APPARATUS FOR FORM MACHINING THE PERIPHERAL EDGE OF SPECTACLE LENSES

(75) Inventors: Joerg Luderich, Ratingen (DE); Fritz Kötting, Dormagen (DE)

(73) Assignee: Wernicke & Co. GmbH (DE)

( * ) Notice: Subject to any disclaimer, the term of this patent is extended or adjusted under 35 U.S.C. 154(b) by 0 days.

(21) Appl. No.: 09/937,549

(22) PCT Filed: Mar. 23, 2000

(86) PCT No.: PCT/EP00/02557

§ 371 (c)(1),
(2), (4) Date: Jan. 28, 2002

(87) PCT Pub. No.: WO00/58052

PCT Pub. Date: Oct. 5, 2000

(30) Foreign Application Priority Data

Mar. 29, 1999 (DE) ..... 199 14 174

(51) Int. Cl.[7] ..... B24B 49/00

(52) U.S. Cl. ..... 451/43; 451/5; 451/9; 451/240; 451/256

(58) Field of Search ..... 451/5, 6, 9–11, 451/42, 43, 44, 240, 210, 255, 256

(56) References Cited

U.S. PATENT DOCUMENTS 3,834,089 A * 9/1974 Barnett ..... 451/43
4,972,632 A * 11/1990 Brueck ..... 451/256
5,630,746 A * 5/1997 Gottschald et al. ..... 451/255
5,803,793 A * 9/1998 Mizuno et al. ..... 451/255
5,993,294 A * 11/1999 Gottschald ..... 451/255
6,123,604 A 9/2000 Mizuno et al.
6,283,826 B1 * 2/2001 Mizuno ..... 451/5
6,220,929 B1 * 4/2001 Mizuno ..... 451/10
6,261,150 B1 * 7/2001 Mizuno et al. ..... 451/43

FOREIGN PATENT DOCUMENTS

| | | | |
|---|---|---|---|
| DE | 19632340 | 2/1998 | |
| EP | 0797076 | 10/1997 | |
| EP | 0894568 | 2/1999 | |
| EP | 968790 A2 * | 1/2000 | ..... B24B/9/14 |

* cited by examiner

*Primary Examiner*—Joseph J. Hail, III
*Assistant Examiner*—David B. Thomas
(74) *Attorney, Agent, or Firm*—Ostrolenk, Faber, Gerb & Soffen, LLP

(57) ABSTRACT

The invention relates to a method and a device for machining the peripheral edge of spectacle lenses and for optionally applying a subsequent facet thereto. The device comprises a driven spectacle-lens holding shaft which holds the spectacle lens and a machining tool which can be moved in a controlled manner in relation to the spectacle-lens holding shaft. The torque of the spectacle-lens holding shaft is measured and said holding shaft is driven at a constant rotational speed if and for the length of time that the torque is less than or equal to a predetermined value. The torque of the spectacle-lens holding shaft is decreased optionally to a standstill if and for the length of time that the torque exceeds the predetermined value.

5 Claims, 1 Drawing Sheet

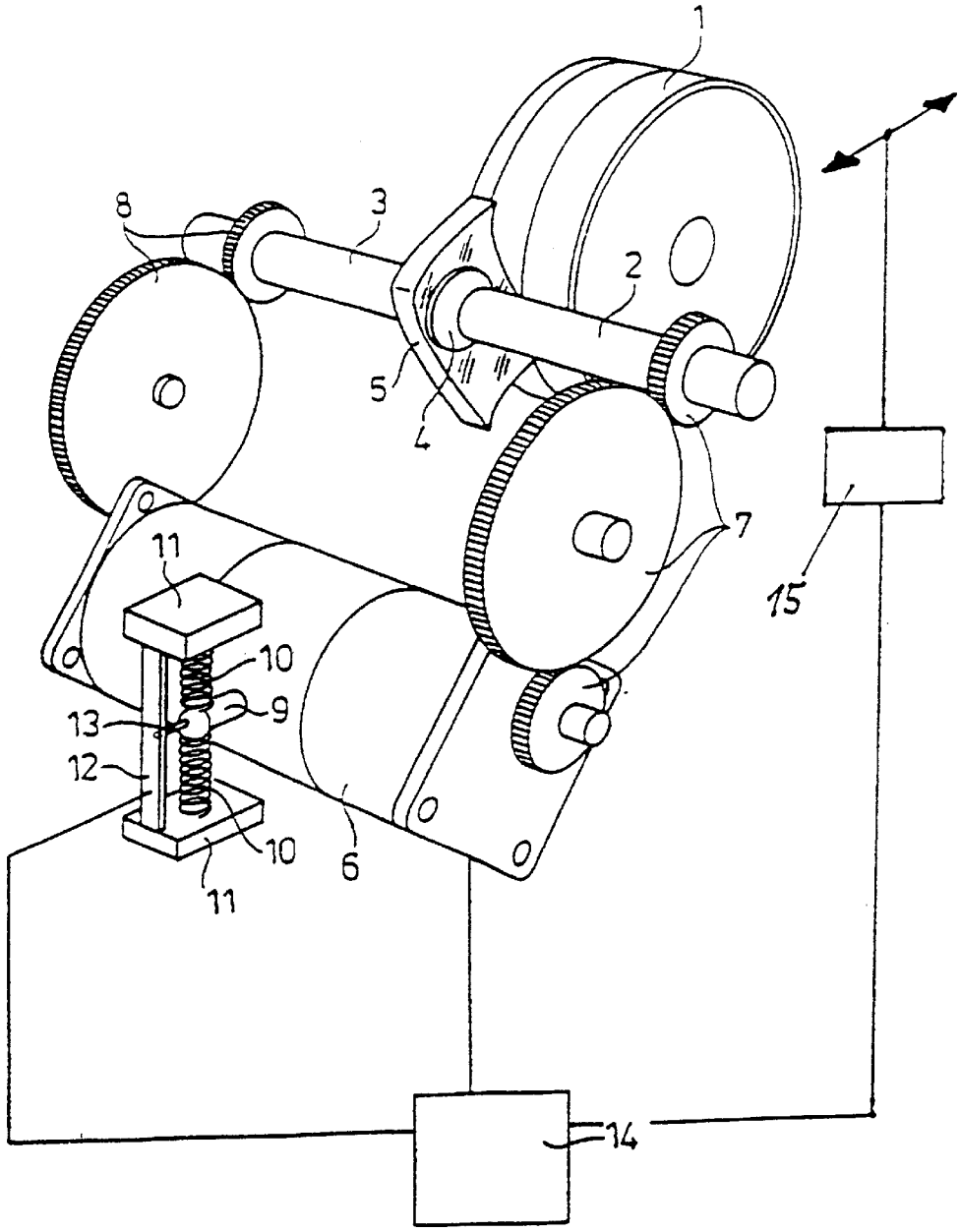
1
2
3
4
5
6
7
8
9
10
10
11
11
12
13
14
15

METHOD AND APPARATUS FOR FORM MACHINING THE PERIPHERAL EDGE OF SPECTACLE LENSES

The invention relates to a method and an apparatus for form machining the peripheral edge of spectacle lenses and of subsequently applying, if need be, a bevel, having a driven spectacle-lens holding shaft holding the spectacle lens and a cutting tool movable in a controlled manner in relation to the spectacle-lens holding shaft.

In order to carry out the form machining of the peripheral edge of spectacle lenses as quickly as possible without the risk of breaking or damaging the spectacle lenses and at the same time definitely avoid a situation in which the spectacle lens clamped in place in the spectacle-lens holding shaft slips through, it is known according to DE 196 16 536 A1 of the same applicant for the force with which the cutting tool is guided against the spectacle lens to be increased in a controlled manner as a function of the respective radius, from a large radius to a small radius, in the bearing region of the spectacle lens touching the cutting tool. In this way, the cutting pressure can be set in such a way that, at a large spectacle-lens radius touching the grinding wheel, it is just so large that a situation in which the spectacle lens clamped in place in the spectacle-lens holding shaft slips through is just avoided, in which case the cutting pressure can be increased with decreasing radius, and this increase in turn, on the one hand, depends on the permissible instantaneous torque exerted on the spectacle lens by the cutting pressure, but, on the other hand, must not become so large that the spectacle lens is damaged or even destroyed as a result.

In this known method, the cutting pressure can be controlled by means of a data volume of a computer, which also controls the form machining of the spectacle lens by means of this data volume. In particular, the cutting pressure can be controlled by varying the torque transmitted by the servomotor moving the cutting tool relative to the spectacle-lens holding shaft, in which case the variation in the torque can be carried out either by means of a torque-controlled servomotor or by means of a torque-controlled coupling between the servomotor and the cutting tool which can be fed in.

The method described above and the associated apparatus have proved successful; however, a relatively complicated control is required for this.

It is known from DE 196 32 340 A1 to measure the torque of the drive motor of a spectacle-lens holding shaft and/or of a grinding-wheel spindle in a spectacle-lens edging machine and to use it to control the cutting force. A variation in the cutting force is achieved by influencing a vertical-adjustment device for the spectacle-lens holding shaft, which is activated in such a way that a pin descends, specifically in such a way that a predetermined grinding pressure is obtained in the contact region between the raw glass and the grinding wheel.

The method described above has proved successful, but can be simplified if the control for the shaping of the spectacle lens is separated from the control of the applied pressure.

The problem underlying the invention is likewise to provide a method and an apparatus for form machining the peripheral edge of spectacle lenses and for subsequently applying, if need be, a bevel, with which a situation in which the spectacle lens clamped in place in the spectacle-lens holding shaft slips through is definitely avoided, and with which the form machining of the peripheral edge of spectacle lenses can be carried out as quickly as possible without the risk of breaking or damaging the spectacle lenses, in which case this method and the apparatus are to be of simple design or construction and are not to require a complicated control.

Starting from this definition of the problem, it is proposed in a method of the type mentioned at the beginning that the torque of the spectacle-lens holding shaft be measured, that form machining of the peripheral edge of the rotating spectacle lens be carried out with a predeterminable, adjustable force of the cutting tool if and as long as the torque is less than or equal to a predetermined, set value, and that the cutting-tool force acting on the spectacle lens be reduced by reducing the rotational speed of the spectacle-lens holding shaft, if need be until it stops, if and as long as the torque exceeds the predetermined value.

As a result, the cutting force acting on the spectacle lens clamped in place in the spectacle-lens holding shaft always remains below a predeterminable value at which the spectacle lens definitely does not slip through. This method has the advantage that it can be integrated in a spectacle-lens edging machine independently of the control of the form machining, if need be even by retrofitting. For example, the method according to the invention does not depend on whether the form machining of the spectacle lens is effected in a CNC-controlled manner or by copy grinding with the aid of a form wheel.

The measurement of the torque of the spectacle-lens holding shaft can be carried out in different ways, for example by measuring the torque of the drive motor of the spectacle-lens holding shaft. This torque is proportional to the power input, so that the measurement of the torque can be achieved by measuring the power input of the drive motor. Likewise, the torque of the drive motor can be measured at the housing of the drive motor if this housing is mounted on an elastic support so as to be slightly rotatable and the displacement of the elastic support is measured.

The rotational speed of the spectacle-lens holding shaft may be controlled either in such a way that it is reduced in proportion to the amount by which the predetermined value of the torque is exceeded or by the spectacle-lens holding shaft being stopped for as long as a predetermined value of the torque is exceeded.

According to the invention, the apparatus for form machining the peripheral edge of spectacle lenses and for subsequently applying, if need be, a bevel, having a driven spectacle-lens holding shaft holding the spectacle lens and a cutting tool movable in a controlled manner in relation to the spectacle-lens holding shaft, has a measuring device for measuring the torque of the spectacle-lens holding shaft, and a control device for the force, acting on the spectacle lens, of the cutting tool for reducing this force by reducing the rotational speed of the spectacle-lens holding shaft, if need be until it stops, if and as long as the torque exceeds a predetermined value.

The control device can act on the drive of the spectacle-lens holding shaft for reducing the rotational speed of the spectacle-lens holding shaft, if need be until it stops.

The measuring device for measuring the torque preferably has an elastic support of the rotatably mounted housing of the drive motor for the spectacle-lens holding shaft, in which case a position encoder interacting with the control device may be arranged on the support, and the control device brings about a reduction in the rotational speed of the spectacle-lens holding shaft in proportion to the amount by which a predetermined displacement of the position encoder is exceeded.

An especially advantageous embodiment of the apparatus according to the invention is obtained if the elastic support is prestressed in such a way that that a movement does not occur until the prestress is exceeded, i.e. until the predetermined torque is exceeded, and in which an electrical contact interacts with the elastic support, this electrical contact interrupting the power supply to the drive motor when the prestress is exceeded.

The method according to the invention and the apparatus can be combined with the method described in DE 196 16 536 A1 in such a way that, on the one hand, the cutting pressure is increased in a controlled manner as a function of the respective radius, from a large radius to a small radius, in the bearing region of the spectacle lens touching the cutting tool and, on the other hand, the rotational speed of the spectacle-lens holding shaft is reduced, if need be until it stops, if and as long as the torque exceeds the predetermined value.

The invention is explained in more detail below with reference to an exemplary embodiment shown in the drawing. With regard to the details of a spectacle-lens edging machine which is designed according to the invention, reference is made to DE 196 16 536 A1 of the same applicant.

Of a spectacle-lens edging machine, a cutting tool in the form of a grinding-wheel stack 1 is shown, a spectacle-lens holding shaft consisting of two halves 2, 3 being arranged relative to the grinding-wheel stack 1 in an axially parallel manner. A spectacle lens 5 provided with a block or sucker 4 is clamped in place between the halves 2, 3 of the spectacle-lens holding shaft. The form grinding of the spectacle lens 5 is effected in such a way that the spectacle lens 5 is set in slow rotation by the spectacle-lens holding shaft 2, 3, while the grinding-wheel stack 1 rotates at high speed. In the process, the distance between the spectacle-lens holding shaft 2, 3 with the clamped spectacle lens 5 and the grinding-wheel stack 1 is varied in a controlled manner by means of a motion drive 15 in accordance with the shape of the spectacle lens to be machined. It is also possible, with the grinding-wheel stack 1 stationary, to move the spectacle-lens holding shaft 2 relative to the grinding-wheel stack 1.

The spectacle-lens holding shaft 2, 3 is driven by a geared motor 6 via gear sets 7, 8.

During the form machining, the spectacle lens 5 must be rotated by the geared motor 6 with varying torque, which depends on the cutting pressure between the grinding-wheel stack 1 and the spectacle lens 5 and on the respective radius of the spectacle lens 5. If this torque exceeds a known empirical value, the spectacle lens 5 clamped in place between the halves 2, 3 of the spectacle-lens holding shaft may slip through, which on no account must occur if the spectacle lens to be machined has a lower segment oriented at a precise angle with regard to the optical axis or a cylindrical or prismatic cut whose axis position relative to the arrangement of the spectacle lens in the spectacle frame is predetermined.

The maximum torque which can be transmitted in each case depends on the material of the spectacle lens and on its surface treatment. Highly anti-reflective spectacle lenses, for example, have an especially low coefficient of friction relative to holding devices on the spectacle-lens holding shaft or mounted blocks or suckers.

The housing of the geared motor 6 is mounted in a rotatable manner in the spectacle-lens edging machine and is supported on springs 10 via an extension 9. These springs are arranged between fixed, adjustable abutments 11, so that an adjustable prestress can be imparted to the springs 10, this prestress being a measure of the torque which can be transmitted by the geared motor 6 before the housing of the geared motor 6 is rotated against the force of the springs 10. A position encoder 12 is arranged parallel to the springs 10 and interacts with a pin 13. If a certain, adjustable torque of the geared motor 6 is now exceeded, a deflection of the pin 13 relative to the position encoder 12 occurs. This deflection is measured and transmitted to a control device 14, which reduces the rotational speed of the geared motor 6, if need be until it is stopped.

For example, the prestress of the springs 10 can be set in such a way that a deflection of the pin 13 occurs starting from a certain torque which is still below the permissible torque, this deflection bringing about a proportional reduction in the rotational speed of the geared motor 6 via the position encoder 12 and the control device 14. If a certain deflection, i.e. a certain, higher torque, is achieved, the control device 14 can stop the geared motor 6, and this geared motor 6 remains stopped for as long as the predetermined torque is exceeded.

An especially simple embodiment of the invention may consist in the fact that, instead of a position encoder, a limit switch is arranged in the region of the extension 9 or pin 13. This limit switch interrupts the power supply to the geared motor 6 if and as long as a torque which can be set by the prestress of the springs 10 is exceeded. As soon as the torque drops to the set value or drops below it, the limit switch closes again, and the geared motor 6 continues to rotate the spectacle-lens holding shaft 2, 3.

As long as the torque acting on the spectacle-lens holding shaft 2, 3 is less than the predetermined value, continuous grinding of the peripheral edge of the spectacle lens with uninterrupted rotation of the spectacle-lens holding shaft 2, 3 is effected, whereas intermittent grinding is always effected for as long as this set torque is exceeded.

What is claimed is:

1. A method of form machining the peripheral edge of spectacle lenses having a driven spectacle-lens holding shaft holding the spectacle lens and a cutting tool movable in a controlled manner in relation to the spectacle-lens holding shaft, comprising the steps:

measuring the torque of the spectacle-lens holding shaft, form machining the peripheral edge of the rotating spectacle lens with a predeterminable, adjustable force of the cutting tool if and as long as the torque is less than or equal to a predetermined, set value, reducing the cutting-tool force acting on the spectacle lens by reducing the rotational speed of the spectacle-lens holding shaft, if need be until it stops, if and as long as the torque exceeds the predetermined value, wherein the rotational speed of the spectacle-lens holding shaft is reduced in proportion to the amount by which the predetermined value of the torque is exceeded.

2. A method of form machining the peripheral edge of spectacle lenses having a driven spectacle-lens holding shaft holding the spectacle lens and a cutting tool movable in a controlled manner in relation to the spectacle-lens holding shaft, comprising the steps:

measuring the torque of the spectacle-lens holding shaft, form machining the peripheral edge of the rotating spectacle lens with a predeterminable, adjustable force of the cutting tool if and as long as the torque is less than or equal to a predetermined, set value, reducing the cutting-tool force acting on the spectacle lens by reducing the rotational speed of the spectacle-lens holding shaft, if need be until it stops, if and as long as the torque exceeds the predetermined value, wherein the spectacle-lens holding shaft is stopped for as long as a predetermined value of the torque is exceeded.

3. An apparatus for form machining the peripheral edge of spectacle lenses, having a driven spectacle-lens holding shaft holding the spectacle lens and a cutting tool movable in a controlled manner in relation to the spectacle-lens holding shaft, a measuring device for measuring the torque of the spectacle-lens holding shaft, and a control device for the force, acting on the spectacle lens, of the spectacle-lens cutting tool by reducing the rotational speed of the spectacle-lens holding shaft, if need be until it stops, if and as long as the torque exceeds a predetermined set value, wherein the measuring device for measuring the torque has an elastic support of the rotatably mounted housing of the drive motor for the spectacle-lens holding shaft.

4. The apparatus as claimed in claim 3, in which a position encoder interacting with the control device is arranged on the elastic support, and the control device brings about a reduction in the rotational speed of the spectacle-lens holding shaft or an increase in the distance between the cutting tool and the spectacle-lens holding shaft in proportion to an amount by which a measured displacement of the position encoder exceeds a predetermined value.

5. The apparatus as claimed in claim 3, in which the elastic support is prestressed in such a way that a movement does not occur until the prestress is exceeded, and in which an electrical contact interacts with the elastic support, this electrical contact interrupting the power supply to the drive motor when the prestress is exceeded.

* * * * *